US005139138A

United States Patent [19]

Isaksen

[11] Patent Number: 5,139,138

[45] Date of Patent: Aug. 18, 1992

[54] COMBINATION RAZOR AND CONTAINER WITH SHARPENER

[76] Inventor: Olaf L. Isaksen, 1853 Darien Dr., Lexington, Ky. 40504

[21] Appl. No.: 421,657

[22] Filed: Oct. 16, 1989

[51] Int. Cl.[5] ..... B65D 69/00; A45D 27/00

[52] U.S. Cl. ..... 206/228; 51/262 R; 76/86; 132/292; 206/352

[58] Field of Search ..... 206/208, 228, 352-360; 132/289, 292; 76/DIG. 9, 82, 86; 51/262 R, 354, 358

[56] References Cited

U.S. PATENT DOCUMENTS

| | | | |
|---|---|---|---|
| 205,495 | 7/1878 | Molitor | 132/292 X |
| 569,274 | 10/1896 | Carlson et al. | 132/292 |
| 953,948 | 4/1910 | Gaisman | 132/292 |
| 1,165,245 | 12/1915 | Goodwin | 76/86 |
| 1,367,035 | 2/1921 | Gaisman | 206/228 |
| 1,381,724 | 6/1921 | Maloney . | |
| 1,436,213 | 11/1922 | Tasca . | |
| 1,552,918 | 9/1925 | Gaisman | 206/228 |
| 1,743,747 | 1/1930 | Alland | 132/292 X |
| 1,775,518 | 9/1930 | Forbes | 206/208 |
| 1,776,642 | 9/1930 | Stanford | 76/DIG. 9 |
| 1,782,033 | 11/1930 | Forbes | 206/208 |
| 1,859,554 | 5/1932 | De Haven . | |
| 2,043,957 | 6/1936 | De Haven | 132/292 X |
| 2,098,465 | 11/1937 | Polillo . | |
| 2,331,370 | 10/1943 | Bowden | 132/289 |
| 2,366,338 | 1/1945 | Konsel | 132/297 |
| 2,566,909 | 9/1951 | San Cristoval | 76/86 |
| 3,057,062 | 10/1962 | Mashiba . | |

*Primary Examiner*—Bryon P. Gehman
*Attorney, Agent, or Firm*—King & Schickli

[57] ABSTRACT

A razor assembly for shaving, and a combination razor assembly and container for sharpening the razor, is provided. A razor body includes a blade carrier with a reusable blade. A blade guard engages the blade for guiding over the skin surface during shaving. The guard is released to freely expose the blade for cleaning/sharpening while maintaining the blade attached to the carrier. The container includes an opening for receiving the exposed blade and opposed arrays of honing shoes are provided along a path for engaging the blade during sharpening movement of the razor along the container. A guide track having guide grooves engages the blade guard to ensure accurate movement of the blade with respect to the honing shoes. One honing shoe array along one side of the path is spring biased toward the other to assure unison movement and efficient sharpening action. In the razor assembly, a guard extension on the distal end of the blade guard is provided with a spring to urge the guard to the operative position for the shaving mode. A release button is provided for releasing the blade guard for movement away from the blade for cleaning and/or sharpening.

8 Claims, 2 Drawing Sheets

Fig. 4
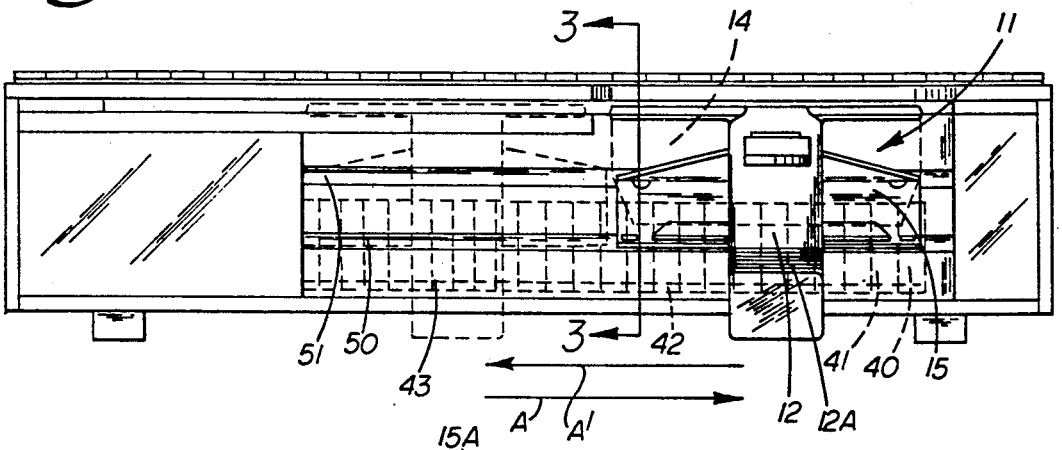
Fig. 5B
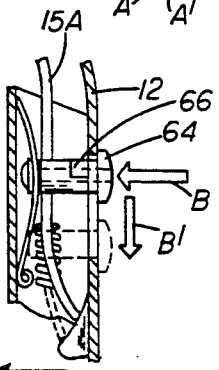
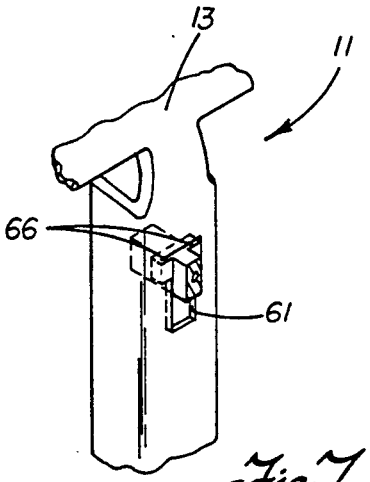
Fig. 7
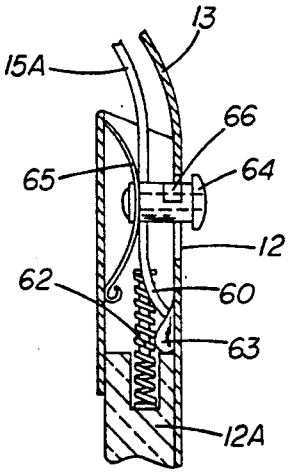
Fig. 5A
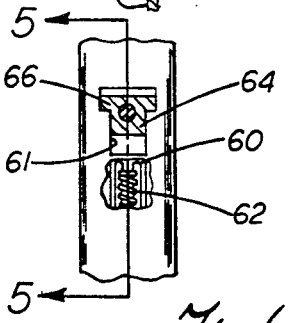
Fig. 6
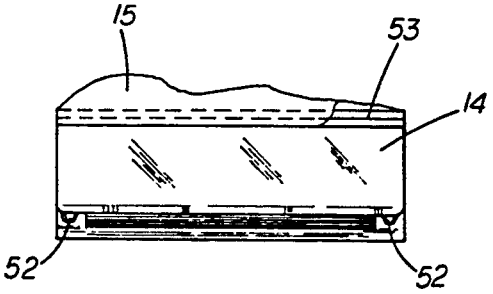
Fig. 8

COMBINATION RAZOR AND CONTAINER WITH SHARPENER

BACKGROUND OF THE INVENTION

The present invention relates to razors for shaving, and more particularly, to a combination razor assembly and container for sharpening and storing the razor assembly.

Until several decades ago, the straight razor was known as the standard for providing a good close shave. Even today, some professional barbers prefer the straight razor for shaving and shaping side burns. The key advantage is that the straight razor has a permanent blade and can be sharpened to a very fine edge by use of honing strops or other sharpening means. With a steady hand, a person using a straight razor can get a very close shave for a minimum expense.

In recent years, as time has become more and more a premium, most consumers have moved toward using the safety razor. The art of obtaining a close shave with a straight razor has thus unfortunately been victimized by our modern society. The sale of safety razors, which includes a razor body and a blade with a blade guard to guide the blade over the skin, until recently was dominant in the shaving industry, especially in the personal use category.

Within the last decade, the safety razor has given way in popularity to the disposable razor that generally includes a molded plastic body with dual blades and integral blade guard or disposable molded plastic blade cartridges. These disposable razors and cartridges generally last for 10-20 shaves before they start pulling the whiskers and providing a generally uncomfortable and undesirable shave. Then the consumer must throw the entire razor or cartridge away, and use a new one. This is not only relatively expensive, but when the old razor or cartridge is thrown away, it inevitably causes pollution of the environment. The pollution results from the inability of the plastic body and the metal blades to biodegrade when placed in a landfill or the like. It is predicted that the move by consumers to demand more biodegradable products will soon lead to some restriction, if not total ban in some areas, on these disposable razors and cartridges.

Another problem with the molded plastic disposable razor or cartridge is that the blade area cannot be conveniently and completely cleaned of whiskers. In other words, there is no way to move the blade guard away from the shaving blades. This inevitably leads to a build-up of whiskers, particularly at the ends of the blade, which restricts the shaving efficiency even more.

In the past, there have been some attempts at providing a permanent blade safety razor with a built-in sharpener. Some of these efforts have met with limited success. The inventors have all attempted to make a commercially acceptable razor where the blade is reusable and can be sharpened at any time, even during the shaving process.

The typical approach for the self-sharpening razors of the past is to build the sharpening apparatus directly in the body or handle of the razor. In this respect, the Tasca U.S. Pat. No. 1,436,213 is representative. The head of the razor in this prior patented device is unscrewed from the end of the handle and the razor blade is then inserted in the opposite end of the handle to be sharpened against a strop or other sharpening means. A later similar effort is shown in the Polillo U.S. Pat. No. 2,098,465 wherein the blade is removed from one end of the razor body and attached to the distal end of the handle. Once it is so attached, the blade is then sharpened in the same manner that a straight razor would be sharpened against the razor strops.

Because of the inconvenience of removing the blade from the shaving position on the razor body, others have attempted to provide a sharpening apparatus integral with the razor where the blade can remain in place. A typical approach of this effort is shown in the De Haven U.S. Pat. No. 1,859,554. The honing stone is mounted integrally with the blade guard and as the blade guard moves outwardly one side of the blade can be honed.

One common problem of all of these prior efforts is that the razor is necessarily made very bulky. The additional structure on the razor body/handle offsets any advantage that might be obtained from having a reusable blade that can be easily sharpened. The mechanism associated with the blade sharpener is complicated and difficult to manufacture within the confines of the razor.

Another approach that has been tried but suffers the same difficulty of the razor being bulky and unwieldly to use, and thus not commercially acceptable, is shown in the Maloney U.S. Pat. No. 1,381,724. In this prior attempt to solve the problem of convenient sharpening of a permanent blade, a container is provided with a sharpening means. The blade, mounted on a removable blade guard, is placed in the container for sharpening. When the razor is ready to be used, the blade and blade guard must be removed from the container and attached to the outside of the container that serves as the handle. As will be realized, holding the entire container while shaving is very difficult. The container is not suited for comfortable positioning in the hand, and particularly for close area shaving around the lips and nose, it would be almost impossible to use. In addition, the weight of holding the entire container, the sharpening apparatus and the blade and blade holder proves to be very unsatisfactory.

Thus, there is a need for a new type of razor that utilizes a reusable blade and can be conveniently sharpened. It is against this background that the objectives, description and claims are presented herein describing my new concept.

SUMMARY OF THE INVENTION

Accordingly, it is a primary object of the present invention to provide a razor that is relatively lightweight and easy to use, and that has a reusable blade that can be easily sharpened.

It is another object of the invention to provide a combination razor assembly for shaving and a container that is separate from the razor assembly for sharpening.

Another object of the invention is to provide a razor assembly for shaving wherein the blade guard is releasable but not removable with the blade exposed for cleaning and easily insertable in a container for sharpening.

It is still another object of the present invention to provide the combination razor assembly and container including an efficient sharpening means and a storage compartment for the razor when not in use.

Another object of the present invention is to provide a razor assembly wherein the reusable blade can be sharpened at will, and with the razor assembly being easy to hold and use for a close shave each time.

It is still another object of the present invention to provide a razor assembly wherein the blade guard is releasable in a very efficient manner for cleaning and sharpening of the reusable blade.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved combination razor assembly for shaving and a container for sharpening the reusable blade while remaining a part of the razor assembly is provided. The razor assembly includes a razor body, a blade carrier and a conventional sized handle. A blade guard engages the blade for guiding over the skin surface during shaving. The overall configuration of the razor assembly allows it to be relatively lightweight and easy to maneuver in hard to reach locations, thus providing an easy and close shave each time.

The blade guard is releasable to expose the blade for cleaning and/or sharpening. At all times, the blade remains securely attached to the carrier. The container has an opening for receiving the exposed blade with means to guide the blade during relative movement against sharpening means in the container. As a consequence, the reusable blade may be conveniently cleaned/sharpened at any time before or during the shaving process. A close, clean shave is assured at a minimum expense to the consume each time.

Preferably, the container includes first and second compartments for housing the sharpening means and for storage of the razor when not in use.

Within the first compartment, a first and second array of pivoted, interdigitated honing shoes is provided between which the blade passes during sharpening. The sharpening action is achieved by placing the blade within the opening of the first compartment and then sliding the entire razor assembly back and forth along the sharpening path defined by the honing shoes. The guide track is engaged by the shaving guard in the release mode of the blade guard and a guide rib and projections on the guard engage guide grooves on the track to assure controlled and accurate sharpening and honing of the blade. The pivoted array of honing shoes is mounted on a spring biased, pivoting bar to insure proper movement in concert during the relative movement between the blade and the honing shoes. The leaf spring that spring biases the movable second array of honing shoes toward the first array assures constant honing pressure.

The razor assembly is constructed so that the blade guard is securely retained in position in the shaving mode. An extension on the blade guard is positioned inside the body of the razor assembly. Retaining means cooperates with the extension to assure this desirable action. In the preferred embodiment, a release button is pressed to move the guard extension so as to move the guard itself away from the blade.

Once the blade is placed within the opening of the container for sharpening, the blade guard and guard extension are released to assure proper travel of the razor assembly along the guide track. Preferably, the distal end of the guard extension is formed as a three prong fork with the center tine receiving a compression spring and the side tines working against a cam to provide the biasing action of the blade guard toward the blade. The only time that the blade guard is not securely positioned against the blade is when the release button is pressed down, or when the blade is in the sharpener. The double spring action automatically returns and holds the blade guard in the safety shaving position.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not a restrictive.

BRIEF DESCRIPTION OF THE DRAWINGS

The accompanying drawing incorporated in and forming a part of the specification, illustrates several aspects of the present invention and together with the description serves to explain the principals of the invention. In the drawing:

FIG. 4 is a front elevational view of the container and showing the razor in position for sharpening by movement along the guide track;

FIGS. 5A and 5B are cross sectional views taken along line 5—5 of FIG. 6 showing the release action of the razor assembly;

FIG. 6 is a top view of the shaver body with the top of the release button removed for clarity showing the forked guard extension within the slide track to allow movement of the extension and blade guard;

FIG. 7 is a view similar to FIG. 6 but including additional portion of the razor body and shown in perspective; and FIG. 8 is an enlarged view of the face of the razor assembly showing the blade with the blade guard in the shaving mode.

DETAILED DESCRIPTION OF THE INVENTION

Figure 1:
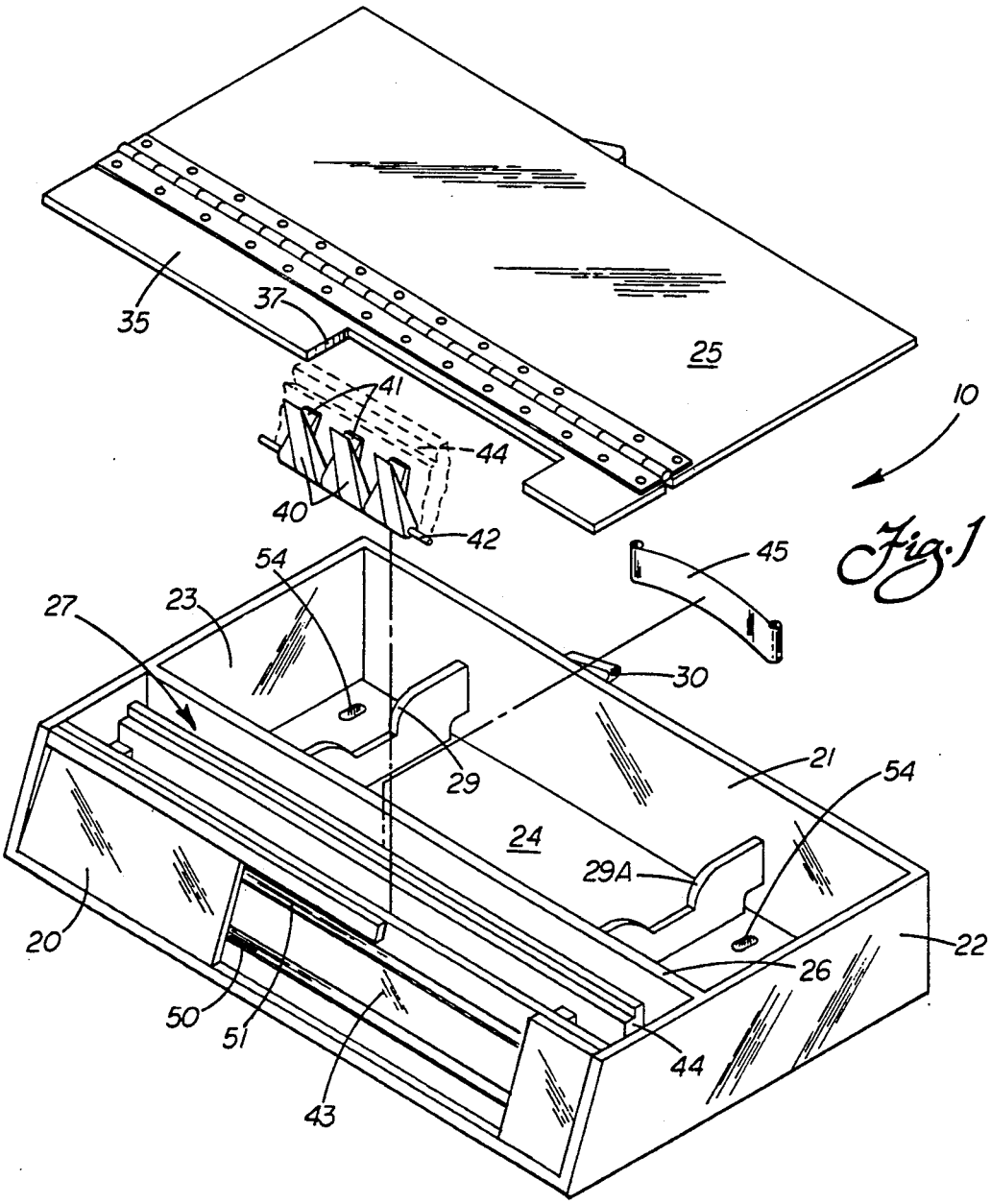
FIG. 1 is an overall exploded, perspective view of the container for sharpening and storage of the safety razor.
Figure 2:
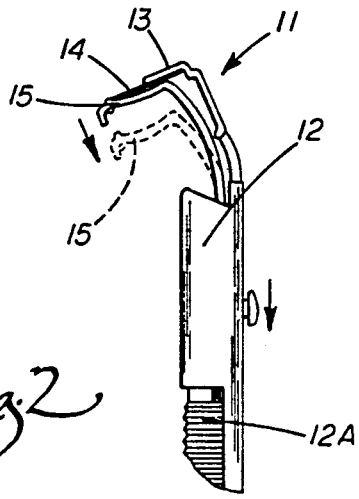
FIG. 2 is a side view of the razor assembly of the present invention, with the distal end of the handle broken away and showing the blade guard in the release mode by dotted line outline.

Reference is now made to FIG. 1 showing the container 10 forming a portion of the combination invention, and to FIG. 2 showing a side view of razor assembly 11 forming the other part of the combination. As will be seen in more detail below, a razor body 12 with handle **12*a* includes a blade carrier 13 presented at an angle designed for easy and comfortable presentation for shaving. Attached to the carrier 13 is a reusable blade 14 that is in turn protected by blade guard 15, which when positioned in the dotted line release mode frees the blade 14 for cleaning and/or sharpening. The blade 14** is preferably a stainless steel straight razor section that can be sharpened and honed many times providing a long life and a lifetime of close and comfortable shaves.

The container 10 is a one piece molded assembly which includes a front wall 20, rear wall 21, connecting side walls 22, 23 and a bottom 24. A divider wall 26 forms a first compartment 27 adjacent the front wall 20 and a second compartment 28 in the rear of the container. Drain orifices 54 can be provided through divider wall 26 and in the bottom of the second compartment in order to allow any small amount of water remaining on the blade 14 after rinsing to escape A pair of cradles 29, 29*a* provide a convenient place for holding and storing the razor assembly 11 when not in use.

Figure 3:
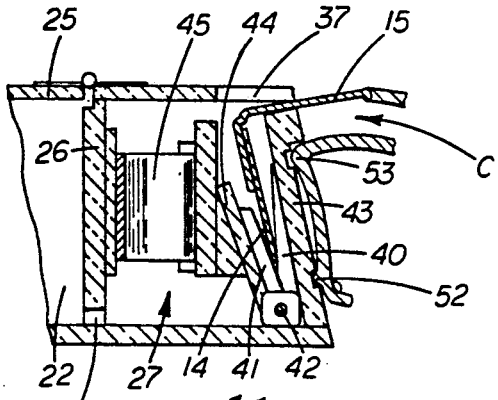
FIG. 3 is a cross sectional view taken along line 3—3 of FIG. 4 and showing the blade positioned for sharpening and honing.

A top panel 35 is permanently attached to the container 10 and pivoted lid 25 provides access to the second compartment. A suitable snap latch 30, 30*a* holds the lid 25 closed. An opening 37 in one end of the panel 35 provides access to the first compartment 27. As best shown in FIG. 3 and in accordance with the invention, the blade 14 is inserted into the compartment 27 through the opening 37 for sharpening.

As can best be seen in FIGS. 1 and 3, the sharpening means for the blade 14 preferably takes the form of opposed, pivoted and interdigitated sharpening elements, that in the preferred embodiment may take the form of tapered honing shoes. The first array 40 of honing shoes may be held on the rear face of guide track 43 that forms a part of the front wall 20 (see FIG. 3). The second array 41 of honing shoes is mounted on a pivotal bar 44 that is attached to the bottom front wall 20 with metal shaft 42. Pivotal bar 44 is urged by leaf spring 45 toward the front of the container 10. In this manner, the interdigitated honing shoes are constantly biased toward each other so that the apex of the space between the honing shoes is adapted at all times to firmly engage the cutting edge of the razor and sharpen it in an efficient manner. The razor assembly 11 is held down during the sharpening process by the underside of the top panel 35.

The spring action on the pivotal support bar 44 maintains the array 41 in alignment for concerted action during the sharpening process. The spring action also keeps the arrays 40, 41 firmly seated and in place against the back of the blade guard 43 and the face of the pivotal bar 44, respectively (see FIG. 3).

The guide track 43 preferably takes the form of a panel having a pair of guide grooves 50, 51. The projections 52, and the guide rib 53, on the face of the blade guard 50 are designed to engage these grooves so that the blade 14 moves in a controlled and accurate fashion during sharpening or honing.

As best shown in FIGS. 3 and 4, during the sharpening operation, the razor assembly 11 is first placed in the release mode by movement of the blade guard 15 away from the blade 14. This action exposes the blade for sharpening. The projections and guide rib 52, 53 at the bottom and top of the blade guard 15 (see FIG. 3) engage the respective guide grooves 50, 51, as the blade is inserted through the opening 37 and then the body 12 of the razor assembly 11 and the handle 12*a* are moved longitudinally along the guide track 43. The movement arrows A, $A_1$, representing the back and forth sharpening or honing movement, are depicted in FIG. 4.

The movement of the blade 14 inside the compartment 27 is along the path defined by the interdigitated honing shoe arrays 40, 41. The support bar 44 floating on the spring 45 constantly urges the arrays 40, 41 together, the top panel 35 keeps the blade 14 down between the arrays assuring constant, smooth honing action.

The individual honing shoes of the arrays 40, 41 are preferably molded honing stones. The stones are tapered and relieved in order to properly receive and guide the blade 14 during the sharpening operation. Alternatively, the pivoted elements may be formed of plastic or other material and include on their operative faces insert sharpening pads of honing stone material. Furthermore, the shoes and/or pads may be made of any other suitable material that will provide sharpening, such as leather strop material or suitably textured surface on steel or other hard material.

As best shown in FIG. 5A and 5B, the body 12 of the razor assembly 11 is hollow. The blade carrier 13 is integral with the body 12 and the blade guard 15 is positioned directly underneath. The blade guard 15 includes a guard extension 15*a* extending downwardly into the body 12 and terminating in a three tined fork 60, which can best be seen through the slide track opening 61 in FIG. 6.

As shown by viewing composite exhibits 5*a* and 6, the middle tine of the fork 60 supports a compression spring 62 that is effective to constantly urge the guard extension 15*a* in an upward direction. As this is done, the blade guard 15 (see FIG. 2) is urged firmly into engagement with the blade 14, and thus to the shaving mode. The two outer tines of the fork 60 engage a pair of cams 63 (only one shown in FIG. 5*a*) to provide additional biasing action of the blade guard 15.

Attached to the guard extension 15*a* is a release button 64 with a leaf spring 65 acting against the inside wall of the razor body 12 to constantly urge the button 64 upwardly toward the slide track opening 61. The upper end of the slide track opening includes a T-slot (see FIGS. 6 and 7) with a pair of locking wings 66 being received therein. In the position shown in FIG. 7 with the wings 66 biased up into the slot, the guard extension 15*a* is positioned so as to firmly lock the guard blade 15 in the shaving mode against the blade 14 (see full line position of FIG. 2). When pressed in and down (see action arrows B, $B_1$), the blade guard 15 is moved to the release mode (see dotted line position of FIG. 2).

The face of the blade 14 is shown in the proper located position just above locating projections 52 in FIG. 8. Likewise, the guide rib 53 under the blade 14 and blade carrier 15 is illustrated.

In operation, when the razor assembly 11 is ready to be cleaned and/or sharpened, the user simply depresses the retainer button 64 and moves the retainer button downwardly along the slide track opening 61 (FIG. 5B). As this is done, the locking wings 66 clear the T-slot at the top of the slide track opening 61 (see FIG. 6) and the distal end of the guard extension 15*a* and the fork 60 moves downwardly, as viewed in FIG. 5*a*. The spring 62 is compressed and the outside tines ride up the cams 63, all of which action biases the guard extension 15*a* in the opposite or upward direction.

Once the blade guard 15 has moved away from the blade 14 to freely expose it to a sufficient degree for the blade 14 to be inserted through the opening 37 of the container 10, and between the arrays 40, 41 of honing shoes, the button 64 is released causing the blade guard 15 to be biased firmly against the guide track 43 (see action arrow C in FIG. 3). The locating projections 52 engage the lower guide groove 50, whereas the guide rib 53 engages the upper guide groove 51. The biasing action holds the blade 14 in firm engagement for sharpening as the movement takes place back and forth along the direction of the arrows A, $A_1$ (see FIG. 4).

In summary, it can be seen that a new and more efficient safety razor assembly 11 and/or combination with a container 10 having a sharpening means is provided. The blade 14 of the assembly is reusable and can be sharpened and honed to a fine edge before and during the shaving process to give a clean, smooth shave each time. The blade guard 15 can be released from engagement with the blade 14 by an easy release action of the release button 64 for cleaning and the sharpening operation. The blade 14 in the release mode is inserted between the arrays 40, 41 of honing shoes that firmly engage on both sides for enhanced sharpening action. The guide track 43 with the guide grooves 50, 51 securely hold the blade during the back and forth movement A, $A_1$ so that the sharpening action is efficient and accurate. Both sides of the blade are equally sharpened and honed to give the best shaving edge. The container conveniently includes a second compartment for holding the razor assembly 11 on cradles 29, **29*a*** for storage.

The razor assembly 11 is relatively simple in construction and lightweight. It includes a handle **12*a* that is easy to grasp and provide convenient and efficient shaving action. The release button 64 is easily actuated and the integral guard extension 15*a* and blade guard 15 are constantly urged toward the blade 14 for advantage. The compression spring 62 and the cams 63 cooperate with the fork 60 in a unique manner to provide the biasing action. The locking wings 66 assure a firm and secure engagement of the blade guard 15 with the blade 14** during the shaving mode.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

What is claimed is:

1. A combination razor assembly for shaving a skin surface and container for sharpening comprising a razor body including a blade carrier;

a reusable blade mounted on the blade carrier;

a blade guard engaging the blade to guide an edge of the blade over the skin surface for shaving;

means to release said guard to expose the blade for cleaning and sharpening while maintaining the blade attached to the carrier;

a container having a top panel and an opening for receiving the exposed blade, means in the container for sharpening the blade while the blade is attached to the carrier; and means to guide said blade for relative movement with respect to said means for sharpening;

whereby the reusable blade may be conveniently sharpened in said container without being removed from the razor assembly.

2. The combination razor assembly and container of claim 1 wherein said container includes at least a first compartment and second compartment; said sharpening means being mounted in said first compartment; and means for storing said razor body when not in use in said second compartment.

3. The combination razor assembly and container of claim 1 wherein said means for sharpening includes first and second opposed arrays of honing elements; said honing elements including opposed sharpening surfaces engaging the blade to sharpen the same.

4. The combination razor assembly and container of claim 3 wherein at least one array of said honing elements includes a plurality of pivoted honing shoes; said honing shoes of the arrays being interdigitated along said container.

5. The combination razor assembly and container of claim 4 wherein said honing shoes are positioned to form a longitudinal path along the container; the opening defining one end of the path; and guide track means for engagement with the blade guard to guide the blade along the path for sharpening.

6. The combination razor assembly and container of claim 5 wherein said guide track means includes at least one groove for receiving a projection on said blade guard for ensuring smooth guiding action of the blade along said path.

7. The combination razor assembly and container of claim 5 wherein said honing shoes are tapered to guide the blade for sharpening; and bar means for said one array of the honing shoes to provide concerted movement as the blade passes between the shoes for sharpening.

8. The combination razor assembly and container of claim 7 wherein is further provided spring means in said container extending along the longitudinal path and operatively engaging said pivoting bar means, whereby the honing shoes are constantly urged against both sides of the blade with the blade being held down between the honing shoes by the top panel for sharpening during the relative movement.

* * * * *